US007686582B2

(12) United States Patent
Cunha

(10) Patent No.: US 7,686,582 B2
(45) Date of Patent: Mar. 30, 2010

(54) RADIAL SPLIT SERPENTINE MICROCIRCUITS

(75) Inventor: Francisco J. Cunha, Avon, CT (US)

(73) Assignee: United Technologies Corporation, Hartford, CT (US)

( * ) Notice: Subject to any disclaimer, the term of this patent is extended or adjusted under 35 U.S.C. 154(b) by 705 days.

(21) Appl. No.: 11/495,131

(22) Filed: Jul. 28, 2006

(65) Prior Publication Data

US 2009/0238694 A1 Sep. 24, 2009

(51) Int. Cl.
*F01D 5/08* (2006.01)
*F01D 5/18* (2006.01)

(52) U.S. Cl. ..... 416/97 R; 415/115

(58) Field of Classification Search ..... 415/115, 415/116, 176, 178; 416/90 R, 92, 96 A, 96 R, 416/97 R, 97 A, 231 R, 223 A
See application file for complete search history.

(56) References Cited

U.S. PATENT DOCUMENTS

| | | | | |
|---|---|---|---|---|
| 6,247,896 | B1 * | 6/2001 | Auxier et al. | 416/97 R |
| 6,254,334 | B1 * | 7/2001 | LaFleur | 415/115 |
| 6,264,428 | B1 * | 7/2001 | Dailey et al. | 416/97 R |
| 6,280,140 | B1 * | 8/2001 | Soechting et al. | 416/97 R |
| 6,379,118 | B2 * | 4/2002 | Lutum et al. | 416/97 R |
| 6,705,831 | B2 * | 3/2004 | Draper | 415/115 |
| 7,137,776 | B2 * | 11/2006 | Draper et al. | 415/115 |

* cited by examiner

*Primary Examiner*—Igor Kershteyn
(74) *Attorney, Agent, or Firm*—Bachman & LaPointe, P.C.

(57) ABSTRACT

A turbine engine component, such as a turbine blade has an airfoil portion with an airfoil mean line, a pressure side, and a suction side. A first region on the pressure side of the airfoil portion has a first array of cooling microcircuits embedded in a wall forming the pressure side. A second region on the pressure side has a second array of cooling microcircuits embedded in the wall. The first region is located on a first side of the mean line and the second region is located on a second side of the mean line.

19 Claims, 4 Drawing Sheets

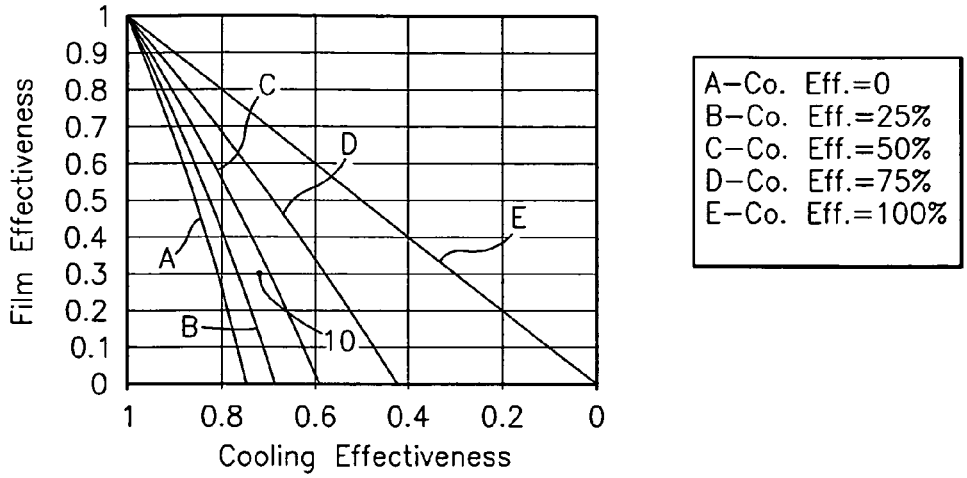
*FIG. 1*
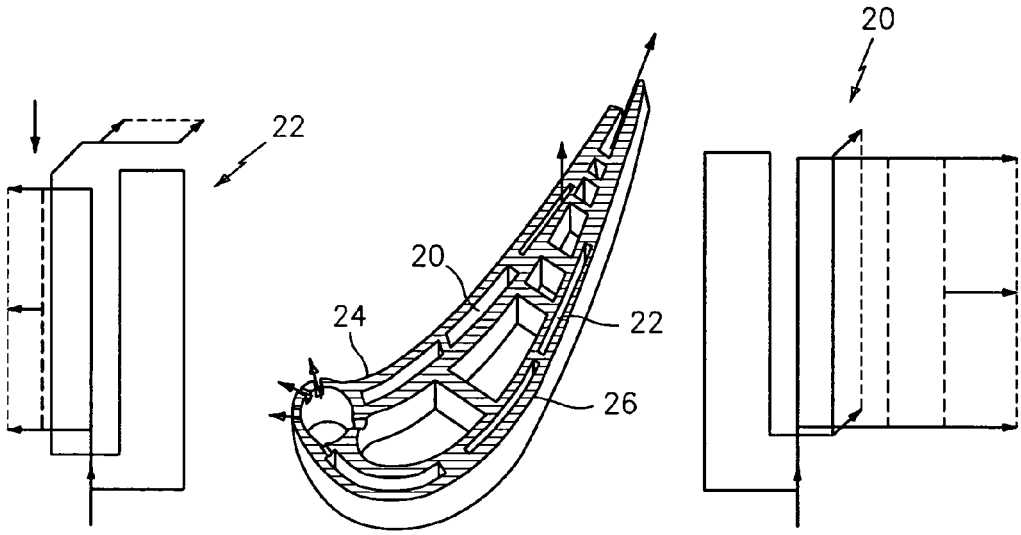
*FIG. 2C* *FIG. 2A* *FIG. 2B*

RADIAL SPLIT SERPENTINE MICROCIRCUITS

BACKGROUND (1) Field of the Invention

The present invention relates to a turbine engine component having an improved scheme for cooling an airfoil portion.

(2) Prior Art

The overall cooling effectiveness is a measure used to determine the cooling characteristics of a particular design. The ideal non-achievable goal is unity, which implies that the metal temperature is the same as the coolant temperature inside an airfoil. The opposite can also occur when the cooling effectiveness is zero implying that the metal temperature is the same as the gas temperature. In that case, the blade material will certainly melt and burn away. In general, existing cooling technology allows the cooling effectiveness to be between 0.5 and 0.6. More advanced technology such as supercooling should be between 0.6 and 0.7. Microcircuit cooling as the most advanced cooling technology in existence today can be made to produce cooling effectiveness higher than 0.7.

FIG. 1 shows a durability map of cooling effectiveness (x-axis) vs. the film effectiveness (y-axis) for different lines of convective efficiency. Placed in the map is a point 10 related to a new advanced serpentine microcircuit shown in FIGS. 2*a*-2*c*. This serpentine microcircuit includes a pressure side serpentine circuit 20 and a suction side serpentine circuit 22 embedded in the airfoil walls 24 and 26.

The Table I below provides the operational parameters used to plot the design point in the durability map.

TABLE I

| Operational Parameters for serpentine microcircuit | |
|---|---|
| beta | 2.898 |
| Tg | 2581 [F] |
| Tc | 1365 [F] |
| Tm | 2050 [F] |
| Tm_bulk | 1709 [F] |
| Phi_loc | 0.437 |
| Phi_bulk | 0.717 |
| Tco | 1640 [F] |
| Tci | 1090 [F] |
| eta_c_loc | 0.573 |
| eta_f | 0.296 |
| Total Cooling Flow | 3.503% |
| WAE | 10.8 |

Legend for Table I
Beta = heat load
Phi_loc = local cooling effectiveness
Phi_bulk = bulk cooling effectiveness
Eta_c_loc = local cooling efficiency
Eta_f = film effectiveness
Tg = gas temperature
Tc = coolant temperature
Tm = metal temperature
Tm_bulk = bulk metal temperature
Tco = exit coolant temperature
Tci = inlet coolant temperature
WAE = compressor engine flow, pps It should be noted that the overall cooling effectiveness from the table is 0.717 for a film effectiveness of 0.296 and a convective efficiency (or ability to pick-up heat) of 0.573. Also note that the corresponding cooling flow for a turbine blade having this cooling microcircuit is 3.5% engine flow. FIG. 3 illustrates the cooling flow distribution for a turbine blade with the serpentine microcircuits of FIGS. 2*a*-2*c* embedded in the airfoils walls.

There are however field problems that can be addressed efficiently with peripheral microcircuit designs. One such field problem is illustrated in FIGS. 4A and 4B. In FIG. 4A, the streamlines of the gas path close to the external surface of the airfoil illustrate four different regions in which the gas flow changes direction or migration: a tip region, two mid-section regions, and a root region. In between the tip and the upper mid region, the flow transitions through a pseudo stagnation point(s). The momentum of the external gas seems to decelerate in such a way as to impose a local thermal load to the part. This manifests itself by regions where the propensity for erosion and oxidation increase in the airfoil surface. The superposition of FIG. 4B illustrates the local coincidence between the pseudo-stagnation region and the blade distress in the part surface. In the mid region, the upper and lower regions also converge onto one another, but even though the space between streamlines decreases, the flow seems to accelerate and there is no pseudo-stagnation regions. A mild manifestation of the same tip-to-mid phenomena seems to initiate in the transition region between the mid-to-root regions. It is therefore necessary to tailor the peripheral microcircuit in such a manner as to address these local high thermal load regions.

SUMMARY OF THE INVENTION

In accordance with the present invention, a turbine engine component is provided with improved cooling. The turbine engine component broadly comprises an airfoil portion having an airfoil mean line, a pressure side, and a suction side, a first region on the pressure side having a first array of cooling microcircuits embedded in a wall forming the pressure side, a second region on the pressure side having a second array of cooling microcircuits embedded in the wall, and the first region being located on a first side of the mean line and the second region being located on a second side of the mean line.

Other details of the radial split serpentine microcircuits of the present invention, as well as other objects and advantages attendant thereto, are set forth in the following detailed description and the accompanying drawings wherein like reference numerals depict like elements.

BRIEF DESCRIPTION OF THE DRAWINGS

FIG. 1 is a graph showing cooling effectiveness versus film effectiveness for a turbine engine component;

FIG. 2A shows an airfoil portion of a turbine engine component having a pressure side cooling microcircuit embedded in the pressure side wall and a suction side cooling microcircuit embedded in the suction side wall;

FIG. 2B is a schematic representation of a pressure side cooling microcircuit used in the airfoil portion of FIG. 2A;

FIG. 2C is a schematic representation of a suction side cooling microcircuit used in the airfoil portion of FIG. 2A;

DETAILED DESCRIPTION OF THE PREFERRED EMBODIMENT(S)

The present invention solves several problems associated with the use of serpentine microcircuits in airfoil portions of turbine engine components such as turbine blades. For example, it has been discovered that the heat transfer for a channel used in a peripheral serpentine cooling microcircuit is much superior if the inlet to the channel is at a 90 degree angle with respect to the direction of flow within the channel. When using such an inlet, it is desirable to place the inlet closer to any distress regions wherever possible to address regions requiring enhanced heat transfer. It has also been discovered that it is advantageous to radially place two microcircuit panels with two 90 degree turn inlets instead of using just one panel with a straight inlet. The duplication of the two circuits disposed radially provide large increases in heat transfer when compared with the same region covered by a panel with a straight inlet.

One area of concern regarding traditional microcircuit cooling is the inability to form the microcircuit within positional tolerance embedded in the airfoil walls. It is therefore desirable to take advantage of placement of microcircuits in the airfoil wall to (1) eliminate areas of known distress; (2) alleviate microcircuit positional problems during forming and subsequent casting of the airfoil; and (3) take advantage of pumping (rotational forces) necessary to lead the flow through the microcircuit peripheral cooling solutions.

Figure 3:
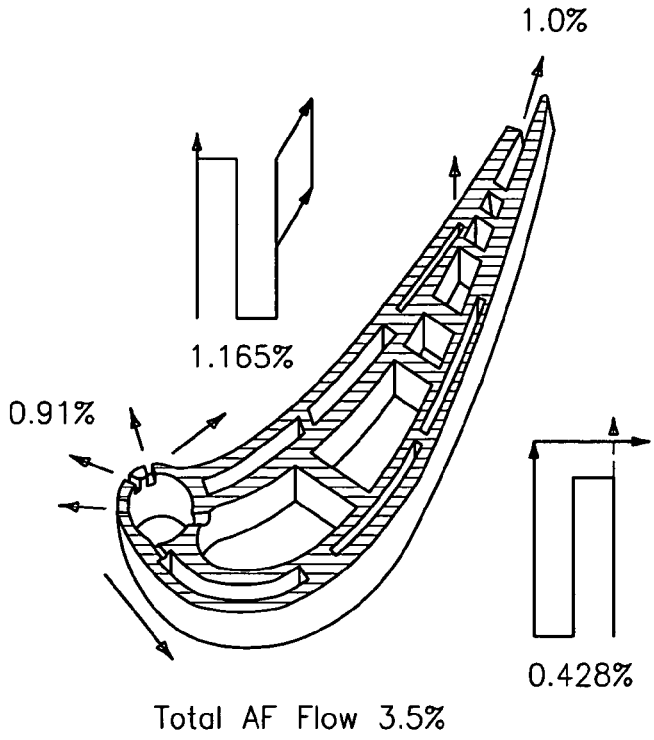
FIG. 3 illustrates the cooling flow distribution for a turbine engine component with serpentine microcircuits embedded in the airfoil walls.
Figure 4A:
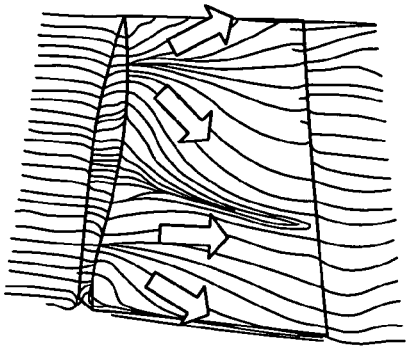
FIG. 4A is a schematic representation illustrating the pressure side distress on an airfoil surface.
Figure 4B:
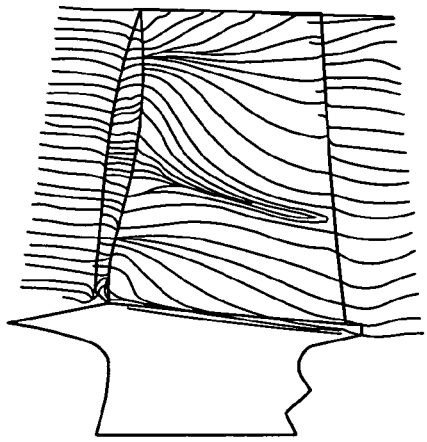
FIG. 4B is a schematic representation of the local coincidence between the pseudo-stagnation region and the blade distress.
Figure 5:
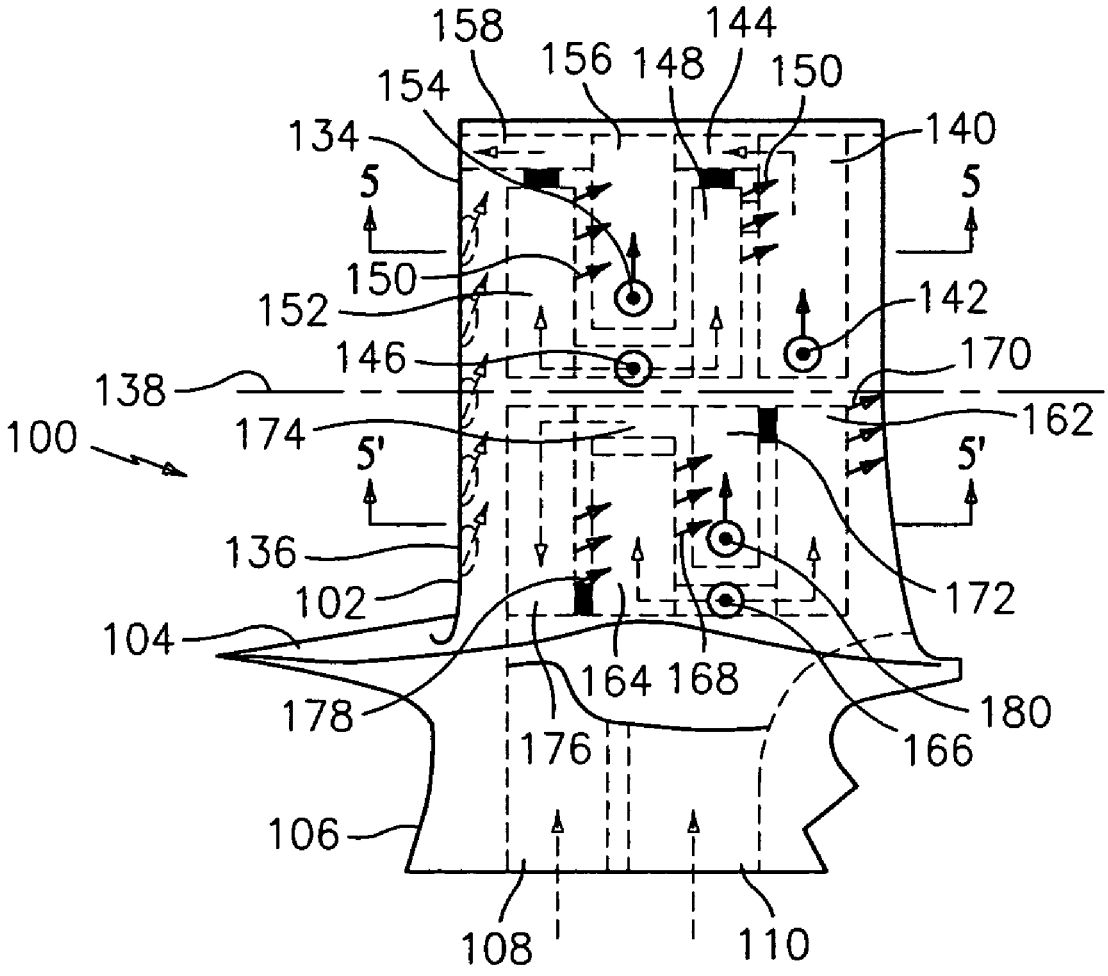
FIG. 5 is a schematic representation of main body cooling circuits with two radial regions used in a turbine engine component.
Figure 6:
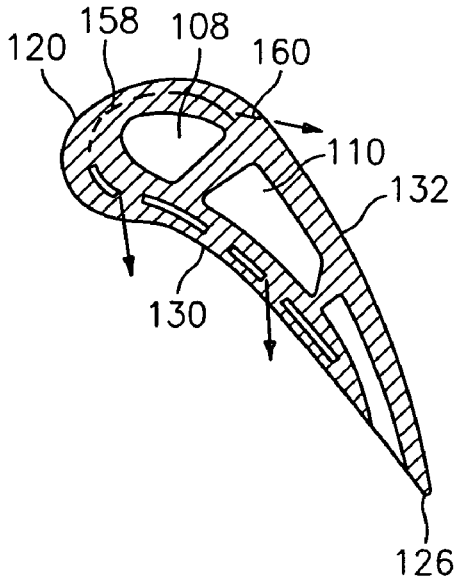
FIG. 6 is a sectional view taken along 5-5 and 5'-5' of FIG. 5.
Figure 7:
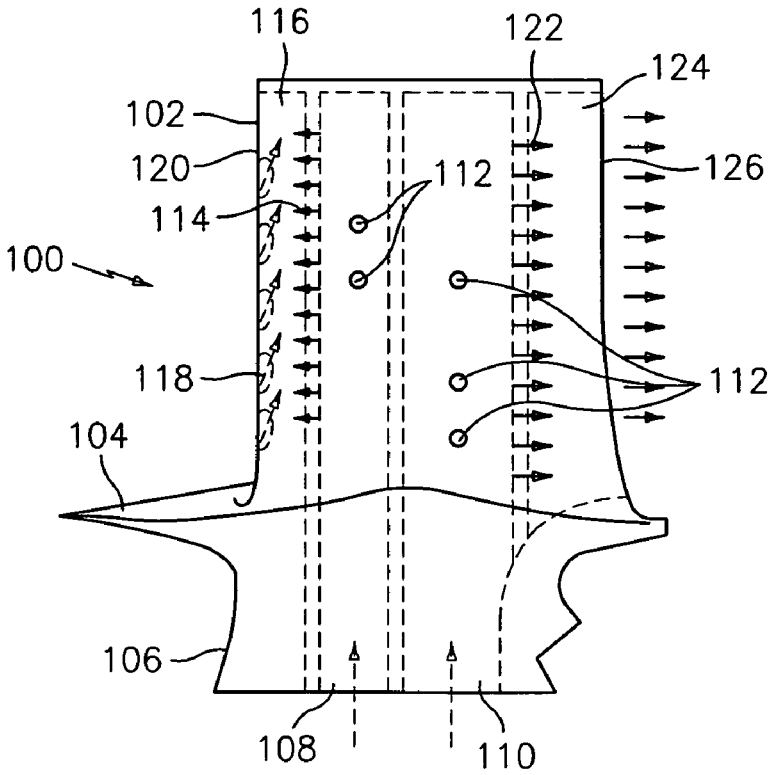
FIG. 7 is a schematic representation of the main body internal cooling circuits.

Referring now to FIGS. 5 through 7, there is shown a turbine engine component 100, such as a turbine blade, having an airfoil portion 102, a platform portion 104, and a root portion 106. As can be seen from FIG. 7, within the airfoil portion 102, there is a leading edge internal circuit 108 and a trailing edge circuit 110. The circuits 108 and 110 communicate with a source (not shown) of cooling fluid such as engine bleed air. Each of the internal circuits is provided with a plurality of feed holes 112 which are used to supply cooling fluid to cooling microcircuits embedded within the walls of the airfoil portion 102. The leading edge internal circuit 108 has a plurality of cross over holes 114 for supplying cooling fluid to a fluid passageway 116. The passageway 116 has a plurality of exit holes 118 for causing cooling fluid to flow over the leading edge 120 of the airfoil portion 102. The trailing edge internal circuit 110 includes a plurality of cross over holes 122 for supplying fluid to a passageway 124 having a plurality of openings to cool the trailing edge 126 of the airfoil portion 102.

The airfoil portion 102 has a pressure side 130 and a suction side 132. Embedded within the wall forming the pressure side 130 are a series of peripheral microcircuits in two regions 134 and 136. The region 134 is located above the airfoil mean line 138 at 50% span, while the region 136 is located below the airfoil mean line 138. Within the region 134, there is located a first fluid passageway 140 having a fluid inlet 142 which communicates with one of the feed holes 112. The fluid inlet 142 has a 90 degree bend. Fluid from the passageway 140 flows into a passageway 144 where the fluid proceeds around the tip of the airfoil portion 102, goes around the leading edge 120 via passageway 158 and discharges on the airfoil suction side 132 via outlet (s) 160.

Within the region 134, there is located a fluid inlet 146 which communicates with one of the feed inlets 112 from the leading edge internal circuit 108. The fluid inlet 146 has a 90 degree bend. Fluid from the inlet 146 is supplied to a first fluid passageway 148 and to a second fluid passageway 152. Each of the fluid passageways 148 and 152 has a plurality of film holes 150 for supplying film cooling over the pressure side 130 of the airfoil portion 102.

Further, within the region 134, there is a located a fluid inlet 154. The fluid inlet 154 has a 90 degree bend. The fluid inlet 154 supplies cooling fluid to a fluid passageway 156 so that the cooling fluid flows in a direction perpendicular to the fluid inlet 154. The fluid passageway communicates with a fluid passageway 158 which wraps around the leading edge 120 of the airfoil portion 102. The fluid passageway 158 has one or more outlets 160 for allowing cooling fluid to flow over the suction side 132 of the airfoil portion 102.

Within the region 136, there is located a fluid passageway 162 and a fluid passageway 164. Each of the fluid passageways 162 and 164 receives fluid from an inlet 166 which communicates with one of the inlets 112 in the trailing edge internal circuit 110. The inlet 166 has a 90 degree bend. The fluid passageway 164 has a plurality of film cooling holes 168 for allowing cooling fluid to flow over the pressure side 130. The fluid passageway 162 has a plurality of exit holes 170 for allowing cooling fluid to flow over the trailing edge 126 of the airfoil portion 102.

Also within the region 136, there is a fluid passageway 172 which communicates with a fluid passageway 174 at a right angle to the passageway 172 and a further fluid passageway 176 at a right angle to the fluid passageway 174. The fluid passageway 176 has a plurality of film cooling holes 178 for allowing cooling fluid to flow over the pressure side 130 of the airfoil portion 102. The fluid passageway 172 communicates with an inlet 180 which has a 90 degree bend. The inlet 180 communicates with one of the feed holes 112 in the trailing edge internal circuit 110.

One advantage of the present invention is that the feeds from the inlets 142, 166, and 180 are radially split to increase internal heat transfer. Further, a plurality of ties 182 may be provided to maintain positional tolerance of the cooling microcircuits with the airfoil wall. Still further, each of the inlets 142, 146, 152, 166, and 180 has a 90 degree turn for supplying cooling fluid to each respective cooling microcircuit. The cooling of the leading and trailing edges 120 and 126 of the airfoil portion 102 protects them from external thermal load by the embedded wall microcircuits. It should also be noted that the peripheral microcircuits are tied together around the airfoil portion 102 to facilitate forming onto the airfoil wall; thus improving castability of the part in subsequent casting processes.

It is apparent that there has been provided in accordance with the present invention radial split serpentine microcircuits which fully satisfy the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A turbine engine component comprising:

an airfoil portion having an airfoil mean line, a pressure side, and a suction side;

a first region on said pressure side having a first array of cooling microcircuits embedded in a wall forming said pressure side;

a second region on said pressure side having a second array of cooling microcircuits embedded in said wall; and said first region being located on a first side of said mean line and said second region being located on a second side of said mean line;

a trailing edge internal circuit within said airfoil portion;

said first array having a first cooling circuit with a first inlet located on said first side of said mean line, said first inlet receiving cooling fluid from said trailing edge internal circuit;

said second array having a second cooling circuit with a second inlet located on said second side of said mean line, said second inlet receiving cooling fluid from said trailing edge internal circuit; and said trailing edge circuit having a plurality of holes for supplying fluid to a passageway having a plurality of openings to cool the trailing edge of the airfoil portion and a plurality of feed holes for supplying fluid to said first and second inlets.

2. The turbine engine component according to claim 1, wherein said second array has a third cooling circuit with a third inlet located on said second side of said mean line, said third inlet receiving cooling fluid from said trailing edge internal circuit.

3. The turbine engine component according to claim 2, wherein each of said first, second and third inlets has a 90 degree bend.

4. The turbine engine component according to claim 2, wherein said third cooling circuit has a sixth passageway and a seventh passageway for receiving cooling fluid from said third cooling inlet.

5. The turbine engine component according to claim 4, wherein said sixth passageway has a plurality of film cooling holes for allowing cooling fluid to flow over the pressure side of said airfoil portion.

6. The turbine engine component according to claim 4, wherein said seventh passageway has a plurality of exit holes for allowing cooling fluid to flow over a trailing edge of said airfoil portion.

7. The turbine engine component according to claim 1, further comprising:

a leading edge internal circuit; and said first array including a fourth cooling circuit having a fourth fluid inlet communicating with said leading edge internal circuit and a fifth cooling circuit having a fifth fluid inlet communicating with said leading edge internal circuit.

8. The turbine engine component according to claim 7, wherein each of said fourth and fifth fluid inlets has a 90 degree bend.

9. The turbine engine component according to claim 7, wherein said fourth cooling circuit has an eighth passageway and a ninth passageway each communicating with the fourth fluid inlet.

10. The turbine engine component according to claim 9, wherein said eighth and ninth passageways are parallel to each other and wherein each of said eighth and ninth passageways have a plurality of film cooling holes for allowing said cooling fluid to flow over said pressure side.

11. The turbine engine component according to claim 7, wherein said leading edge internal circuit communicates with a twelfth passageway having a plurality of openings for allowing said cooling fluid to flow over a leading edge of said airfoil portion.

12. The turbine engine component according to claim 1, wherein said mean line is located at 50% span of said airfoil portion.

13. The turbine engine component according to claim 1, further comprising means for tieing said cooling microcircuits together for improving positional tolerance with said wall.

14. The turbine engine component according to claim 1, wherein said component is a turbine blade.

15. A turbine engine component comprising:

an airfoil portion having an airfoil mean line, a pressure side, and a suction side;

a first region on said pressure side having a first array of cooling microcircuits embedded in a wall forming said pressure side;

a second region on said pressure side having a second array of cooling microcircuits embedded in said wall; and said first region being located on a first side of said mean line and said second region being located on a second side of said mean line;

a trailing edge internal circuit within said airfoil portion;

said first array having a first cooling circuit with a first inlet located on said first side of said mean line, said first inlet receiving cooling fluid from said trailing edge internal circuit;

said second array having a second cooling circuit with a second inlet located on said second side of said mean line, said second inlet receiving cooling fluid from said trailing edge internal circuit, wherein said first cooling circuit has a first passageway and a second passageway at an angle with respect to said first passageway.

16. A turbine engine component comprising:

an airfoil portion having an airfoil mean line, a pressure side, and a suction side;

a first region on said pressure side having a first array of cooling microcircuits embedded in a wall forming said pressure side;

a second region on said pressure side having a second array of cooling microcircuits embedded in said wall; and said first region being located on a first side of said mean line and said second region being located on a second side of said mean line;

a trailing edge internal circuit within said airfoil portion;

said first array having a first cooling circuit with a first inlet located on said first side of said mean line, said first inlet receiving cooling fluid from said trailing edge internal circuit;

said second array having a second cooling circuit with a second inlet located on said second side of said mean line, said second inlet receiving cooling fluid from said trailing edge internal circuit, wherein said second cooling circuit has a third passageway oriented along a span of said airfoil portion, a fourth passageway at an angle with respect to said third passageway, and a fifth passageway at an angle with respect to said fourth passageway.

17. The turbine engine component according to claim 16, wherein said fifth passageway has a plurality of film cooling holes for allowing cooling fluid to flow over the pressure side of said airfoil portion.

18. A turbine engine component comprising:

an airfoil portion having an airfoil mean line, a pressure side, and a suction side;

a first region on said pressure side having a first array of cooling microcircuits embedded in a wall forming said pressure side;

a second region on said pressure side having a second array of cooling microcircuits embedded in said wall; and said first region being located on a first side of said mean line and said second region being located on a second side of said mean line;

a leading edge internal circuit; and said first array including a fourth cooling circuit having a fourth fluid inlet communicating with said leading edge internal circuit and a fifth cooling circuit having a fifth fluid inlet communicating with said leading edge internal circuit, wherein said fifth cooling circuit has a tenth cooling passageway communicating with said fifth fluid inlet and an eleventh cooling passageway communicating with said tenth cooling passageway and wherein said eleventh cooling passageway wraps around a leading edge of said airfoil portion.

19. The turbine engine component according to claim 18, wherein said eleventh cooling passageway has at least one exit hole for allowing cooling fluid to flow over the suction side of said airfoil portion.

* * * * *